United States Patent [19]

Beam, Jr.

[11] Patent Number: 4,623,297

[45] Date of Patent: Nov. 18, 1986

[54] TURBINE ROTOR FOR GAS TURBINE ENGINE

[75] Inventor: Paul E. Beam, Jr., Indianapolis, Ind.

[73] Assignee: General Motors Corporation, Detroit, Mich.

[21] Appl. No.: 737,775

[22] Filed: May 28, 1985

[51] Int. Cl.[4] ..... F01D 25/16

[52] U.S. Cl. ..... 415/118; 415/170 R; 415/122 R; 415/14

[58] Field of Search ..... 415/118, 122 R, 14, 415/30, 46, 170 R, 172 R; 416/61; 73/862.33, 862.34

[56] References Cited

U.S. PATENT DOCUMENTS

| | | | |
|---|---|---|---|
| 3,111,028 | 11/1963 | Lebow | 73/862.33 |
| 3,605,441 | 9/1971 | Hagemeister | 415/112 |
| 4,150,566 | 4/1979 | Loebel et al. | 73/862.34 |
| 4,356,732 | 11/1982 | Hachtel et al. | 73/862.33 |
| 4,432,245 | 2/1984 | Hattori et al. | 73/862.34 |
| 4,488,443 | 12/1984 | Parkinson | 73/862.33 |
| 4,492,906 | 1/1985 | Goto et al. | 73/862.34 |

*Primary Examiner*—Everette A. Powell, Jr.
*Attorney, Agent, or Firm*—Saul Schwartz

[57] ABSTRACT

A rotor for a gas turbine engine includes a turbine wheel with a centerbore therethrough, a main shaft projecting through the centerbore, a turbular stub shaft surrounding the main shaft at a turbine end of the latter and being rigidly connected thereto so that the stub shaft defines a radially spaced reverse flange on the main shaft, a tubular reference shaft around the main shaft having an output end rigidly connected to an output end of the main shaft and a turbine end rotatably journaled on an inside surface of the stub shaft, a plurality of axial slots in the stub shaft, a plurality of pole supports projecting radially from the reference shaft turbine end through the stub shaft slots, a plurality of first pole pieces on the pole supports, a plurality of second pole pieces on the stub shaft between the first pole pieces, and a stationary pick-up operative to develop an electrical signal proportional to the spacing between the pole pieces while the rotor rotates which spacing is proportional to rotor torque.

4 Claims, 2 Drawing Figures

TURBINE ROTOR FOR GAS TURBINE ENGINE

FIELD OF THE INVENTION

Figure 2:
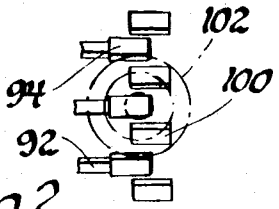

This invention relates generally to gas turbine engines and, more particularly, to turbine rotors therein.

DESCRIPTION OF THE PRIOR ART

Turboshaft gas turbine engines with a turbine section at one end of the engine and a shaft output at the other end of the engine typically include turbine rotors having a tubular, torque carrying main shaft connected to one or more turbine wheels and a reference shaft within the main shaft. The reference shaft is connected to the main shaft at an output end of the latter so that relative angular displacement between an opposite, turbine end of the main shaft and a corresponding free end of the reference shaft is a measure of the torque carried by the main shaft. In this arrangement, the main shaft must be rigid enough to resist bending moments induced by the gyroscopic effect of the turbine wheel, for example, yet torsionally flexible enough for accurate torque measurement. In addition, it is desirable from a service standpoint that the rotor assembly be removable from one end of the engine without the necessity of removing major components at the other end. Heretofore, satisfaction of these competing considerations necessitated use of two bearings at the turbine end of the rotor assembly with the disadvantages accompanying multiple bearing applications such as additional lubrication and space requirements. Conversely, in turbine rotor assemblies of other engines, the reference shaft is a tubular member surrounding the main shaft and is fabricated with sufficient structural rigidity to support the rotor through only two bearings at opposite ends while the main shaft, relieved of its structural support function, is made torsionally flexible for accurate torque measurement. This solution, however, has the turbine ends of the main and reference shafts connected together and the torque measurement apparatus disposed adjacent the output ends of the shafts so that both ends of the engine must be disassembled for rotor removal. A turbine rotor according to this invention has the advantages of the latter described arrangement with the additional advantage of easier disassembly and, therefore, represents an improvement over the described and other known turbine rotors.

SUMMARY OF THE INVENTION

Accordingly, the primary feature of this invention is that it provides a new and improved gas turbine engine turbine rotor. Another feature of this invention is that it provides a new and improved turbine rotor supported on an engine casing through two bearings at opposite turbine and output ends of the rotor wherein rotor torque is measured by transducer apparatus at the turbine end of the rotor so that only turbine end disassembly of the engine is required for rotor removal. Still other features of this invention reside in the provision in the new and improved turbine rotor of a turbine wheel, a main shaft having a reverse cylindrical flange means at a turbine end thereof whereby the turbine wheel is connected to the main shaft and the turbine end of the rotor is supported on the engine casing, a tubular reference shaft around the main shaft with a turbine end disposed freely between the reverse flange means and the main shaft and with an output end rigidly connected to an output end of the main shaft so that relative angular deflection of the turbine ends of the main and reference shafts is proportional to rotor torque, and alternately spaced position reference pole pieces connected to the reverse flange means and to the turbine end of the reference shaft so that the spacing between the pole pieces is also proportional to rotor torque. Yet another feature of this invention resides in the provision in the new and improved turbine rotor of a reverse flange means in the form of a tubular stub shaft around the turbine ends of the reference and the main shafts, the stub shaft being rigidly connected to the turbine wheel at one end and to the main shaft at the other end for torque transmission. And still another feature of this invention resides in the provision in the new and improved turbine rotor of a plurality of axially extending slots in the stub shaft and a corresponding plurality of pole supports extending radially outwardly therethrough from the turbine end of the reference shaft, the pole supports carrying at their distal ends position reference pole pieces cooperating with corresponding position reference pole pieces on the stub shaft.

Figure 1:
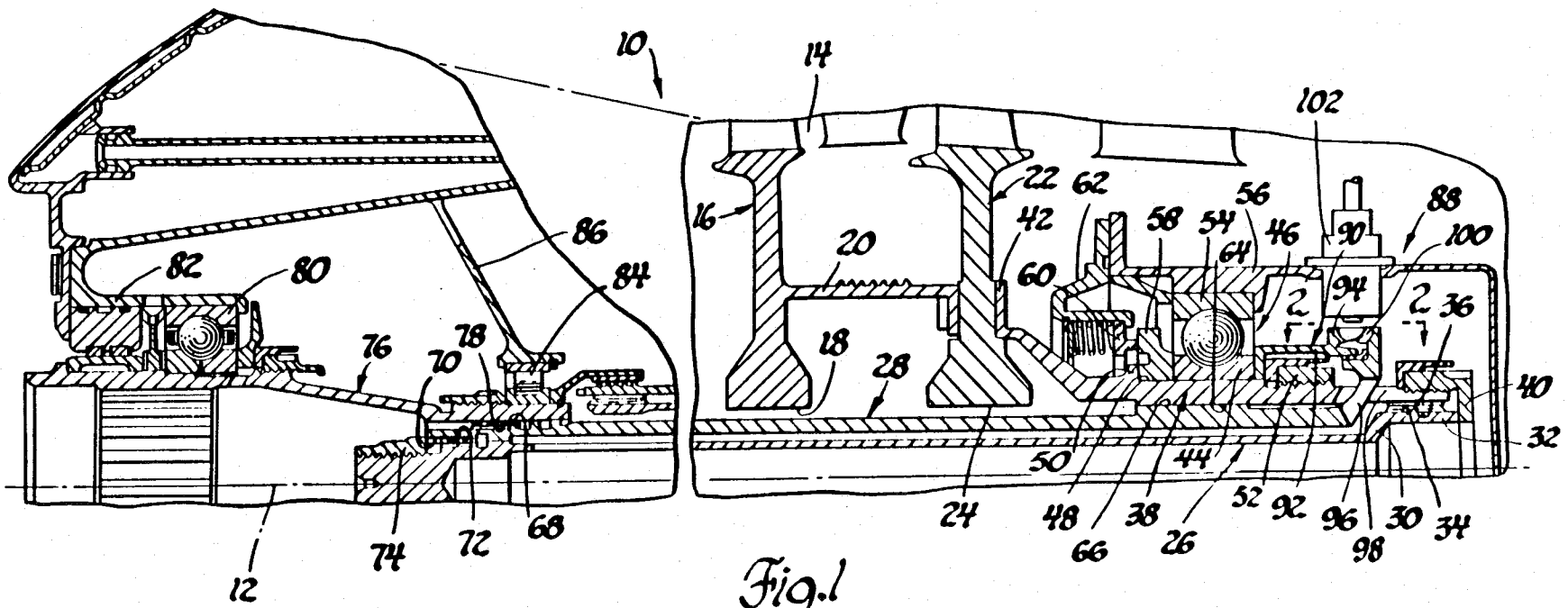

These and other features of this invention will be readily apparent from the following specification and from the drawings wherein:

FIG. 1 is a fragmentary elevational view of a turbine rotor according to this invention; and FIG. 2 is a view taken generally along the plane indicated by lines 2—2 in FIG. 1.

Referring now to the drawings, a fragmentarily illustrated gas turbine rotor 10 according to this invention is supported on a casing or housing, not shown, of a gas turbine engine for rotation about a main axis 12 of the engine. As viewed in FIG. 1, the left end of the rotor 10 is the output end whereat driven apparatus, not shown, is connected to the rotor and the right end is the turbine end whereat power is extracted from a stream of hot gas motive fluid flowing toward the right in an annular flow path 14 around the rotor. A gas generator portion of the engine, not shown, is disposed around the rotor 10 between the output and turbine ends so that the rotor spans generally the entire length of the engine as measured along the main axis 12.

The rotor 10 includes a first turbine wheel 16 having a centerbore 18 therethrough and an axially extending flange 20 integral therewith and a second turbine wheel 22 having a centerbore 24 therethrough. The turbine wheels are rigidly interconnected through the flange 20. The rotor 10 further includes a tubular main shaft 26 aligned with the axis 12 and extending through the centerbores 18 and 24 of the turbine wheels and a tubular reference shaft 28 surrounding the main shaft and also projecting through the centerbores of the turbine wheels. For reference purposes, the rightward ends of the main and reference shafts are designated herein the turbine ends and the leftward ends thereof are designated the output ends.

At the turbine end thereof, the main shaft 26 has an annular shoulder 30 whereby an end portion 32 of the main shaft is displaced radially outward from the remainder of the shaft. A plurality of external splines 34 on the end portion 32 engage a plurality of internal splines 36 on a tubular stub shaft 38 disposed around the turbine ends of the main and reference shafts. The stub shaft is thus rotatable as a unit with the main shaft and forms, in effect, a reverse cylindrical flange of the latter spaced radially outboard therefrom a distance sufficient to freely accommodate the turbine end of the reference shaft between the stub shaft and the main shaft. A cap 40 threaded onto the stub shaft functions to retain the main shaft therewithin. At the end thereof opposite the cap 40, the stub shaft 38 is flared outward and rigidly attached to the second turbine wheel at a flange 42 so that torque developed at the turbine wheels is transferred to the main shaft 26 through the reverse flange defined by the stub shaft 38.

An inner race 44 of a ball bearing 46 is disposed on an outer surface 48 of the stub shaft 38 and is captured between an annular shoulder 50 on the latter and a retainer 52 threaded onto the stub shaft. An outer race 54 of the bearing 46 is mounted on an annular web portion 56 of the engine casing so that the turbine end of the rotor is supported on the engine for rotation about the main axis 12 with the turbine wheels 16 and 22 disposed in planes perpendicular to the main axis. An oil slinger 58 between the inner race 44 and the annular shoulder 50 controls lubricant flow through the bearing 46 while a seal 60 on an extension 62 of the web portion 56 engages the slinger and cooperates therewith in preventing escape of lubricant.

The stub shaft 38 has an internal cylindrical surface 64 within which is rotatably journaled an outside cylindrical surface 66 of the reference shaft 28. The surfaces 64 and 66 have sufficient axial length such that while the reference shaft and stub shafts are freely relatively rotatable they cooperate to form a rigid beam with respect to beam bending loads applied to the rotor. The reference shaft 28 has a plurality of external splines 68 and a plurality of internal splines 70 formed thereon at its output end. Similarly, the main shaft 26 within the reference shaft 28 has formed thereon a plurality of external splines 72 at its output end. The external splines 72 engage the internal splines 70 whereby the output ends of the reference shaft and main shaft are rigidly connected for rotation as a unit about the main axis 12. A retainer 74 is threaded onto the end of main shaft 26 and defines a stop against which the output end of the reference shaft abuts.

A generally cylindrical output member 76 has a plurality of internal splines 78 at one end thereof engaging the external splines 68 on the reference shaft 28 whereby the output member 76 is rotatable as a unit with the output ends of the reference and main shafts 28 and 26. A ball bearing 80 disposed between the output member 76 and a stationary support 82 of the engine casing cooperates with a roller bearing 84 between the output member and a stationary web portion 86 of the engine casing in supporting the output end of the turbine rotor 10 on the engine for rotation about the main axis 12.

A torque transducer 88 is disposed at the turbine end of the turbine rotor 10 rearward or aft of the bearing 46 and includes a main shaft position indicator 90 clamped between the retainer 52 and the inner race 44 of the bearing 46. The indicator 90 is rotatable as a unit with the stub shaft and includes a plurality of circumferentially spaced axially extending pole supports 92 disposed radially outboard of the stub shaft, and carrying at their distal ends a corresponding plurality of pole pieces 94.

The transducer 88 further includes a reference shaft position indicator in the form of a plurality of pole supports 96 integral with the reference shaft 28 and extending radially from the turbine end thereof through corresponding ones of a plurality of slots in the stub shaft extending axially from the adjacent end of the latter, only a single slot 98 being shown in the FIG. 1. Each of the pole supports 96 has at its distal end a pole piece 100 disposed between corresponding ones of the pole pieces 94 on the main shaft position indicator 90. The spacing between the alternately spaced pole pieces 94 and 100 is sensed by a pick-up 102 supported on the web portion 56 of the engine casing.

Describing now the operation of the rotor 10, hot gas motive fluid develops torque on the turbine wheels 16 and 22 which is transferred to the main shaft 26 through the stub shaft 38 and the splines 34 and 36. The wall thickness of the stub shaft 38 is calculated to provide substantial rigidity so that there is very little torsional deflection of the stub shaft as it transfers torque from the turbine wheels to the main shaft 26 at the turbine end of the latter. Accordingly, the pole pieces 94 on the main shaft position indicator 90 are rigidly attached to the main shaft and represent the angular position of the turbine end of the latter at any instant of time. The torque is then carried by the main shaft 26, the splines 72, 70, 68 and 78 to the output member 76 and therefrom to the driven load.

Under torque load, the main shaft torsionally deflects or twists between its turbine and output ends through an included angle proportional to the magnitude of the load. Conversely, because the reference shaft is attached at its output end to the output end of the main shaft but free at its turbine end adjacent the turbine end of the main shaft, the angular position of the turbine end of the reference shaft, and the pole pieces 100 thereon, relative to the angular position of the turbine end of the main shaft, and the pole pieces 94 connected thereto, represents an indication of the torque load on the main shaft. Accordingly, as the rotor rotates under load the pick-up 102 continuously monitors the relative angular positions of the turbine ends of the main shaft and reference shaft as represented by the relative spacing between the pole pieces. The signal from the pick-up is presented to an appropriate logic unit, not shown, which converts the signal to a calibrated output signal indicative of rotor torque.

In a mobile application of the gas turbine engine, as in an aircraft, changes in direction of movement of the vehicle on which the engine is mounted induce gyroscopic bending moments on the rotor which are resisted at the bearings at opposite ends of the rotor. Because the stub shaft is not a reference member with respect to torque measurement and because the reference shaft is not a torque carrying member, these two shafts can be designed with as much rigidity as necessary to resist the gyroscopic bending moments, in particular, and other structural loads generally. Accordingly, only the single ball bearing 46 at the turbine end of the rotor is required.

With respect to assembly and disassembly of the engine, the rotor 10 is retractable from the turbine end of the engine without removal of components at the output end. In particular, once sufficient structure has been removed from the engine at the turbine end thereof to permit removal of the rotor, the latter is simply withdrawn to the right as viewed in the figure. During such withdrawal, the splines 68 on the reference shaft separate axially from the splines 78 on the output member 76. In addition, should withdrawal of only the reference and main shafts 28 and 26, respectively, be required, it is necessary only to remove the cap 40 whereupon both shafts are removed to the right through the centerbores 18 and 24 of the turbine wheels 16 and 22, respectively, and through the interior of the tubular stub shaft 38. During withdrawal of the reference and main shafts, the pole supports 96 traverse the slots in the stub shaft represented by slot 98 and exit the turbine end of the stub shaft through the open ends of the slots.

The embodiments of the invention in which an exclusive property or privilege is claimed are defined as follows:

1. In a gas turbine engine having a casing defining an axis of said engine, a rotor for disposition between a pair of anti-friction bearings disposed on said casing and aligned on said axis comprising, a turbine wheel disposed between said bearings in a plane perpendicular to said axis and including a centerbore therethrough, a main shaft aligned on said axis projecting through said centerbore with a turbine end on one side of said turbine wheel and an output end on the other side thereof, means defining reversed flange on said main shaft turbine end radially outboard of said main shaft, means connecting said reversed flange to said turbine wheel for torque transfer to said main shaft, one of said bearings engaging said reversed flange for rotatably supporting a turbine end of said rotor on said engine casing, a tubular reference shaft around said main shaft projecting through said centerbore with a turbine end of said reference shaft disposed between said reversed flange and said main shaft and with an output end of said reference shaft rigidly connected to said main shaft output end, journal bearing means between an outer surface of said reference shaft and an inner surface of said reversed flange whereby said reference shaft turbine end and said reversed flange are freely relatively rotatable but unitized to resist beam bending of said rotor, the other of said bearings engaging said reference shaft generally at said output end thereof whereby an output end of said rotor is rotatably supported on said engine casing, and transducer means between said turbine end of said main shaft and said turbine end of said reference shaft operative to generate a signal proportional to the relative angular positions of said main shaft turbine end and said reference shaft turbine end.

2. The gas turbine engine rotor recited in claim 1 wherein said means defining said reverse flange includes a tubular stub shaft disposed around said turbine end of said reference shaft and said turbine end of said main shaft, means defining a plurality of splines on said main shaft at said turbine end thereof, and means defining a plurality of splines on said stub shaft engaging said splines on said main shaft whereby said stub shaft and said main shaft are rotatable as a unit.

3. The gas turbine engine rotor recited in claim 2 wherein said transducer means includes a plurality of first pole pieces, means rigidly connecting each of said first pole pieces in a circumferentially spaced array to said stub shaft, a plurality of second pole pieces, means rigidly connecting each of said second pole pieces in a circumferentially spaced array to said turbine end of said reference shaft, each of said second pole pieces being disposed between an adjacent pair of said first pole pieces so that the spacing between adjacent ones of said first and said second pole pieces is representative of rotor torque, and pick-up means on said engine operative during rotor rotation to develop an electrical signal proportional the spacing between adjacent ones of said first and said second pole pieces.

4. The gas turbine engine rotor recited in claim 3 wherein said stub shaft includes a plurality of circumferentially spaced slots extending axially from one end of said stub shaft and said means rigidly connecting said second pole pieces to said turbine end of said reference shaft includes a plurality of pole supports extending radially outward from said turbine end of reference shaft through corresponding ones of said stub shaft slots to respective ones of said pole pieces.

* * * * *